US007827810B2

(12) United States Patent
Hur et al.

(10) Patent No.: US 7,827,810 B2
(45) Date of Patent: Nov. 9, 2010

(54) AIR CONDITIONER

(75) Inventors: Inn Ku Hur, Seoul (KR); Chang Yoon Woo, Changwon-si (KR); Ju Ho Ock, Masan-si (KR); Jae Buem Bae, Jinju-si (KR)

(73) Assignee: LG Electronics Inc., Seoul (KR)

( * ) Notice: Subject to any disclaimer, the term of this patent is extended or adjusted under 35 U.S.C. 154(b) by 1233 days.

(21) Appl. No.: 11/101,528

(22) Filed: Apr. 8, 2005

(65) Prior Publication Data

US 2006/0021359 A1 Feb. 2, 2006

(30) Foreign Application Priority Data

Jul. 27, 2004 (KR) ..... 10-2004-0058666
Jul. 30, 2004 (KR) ..... 10-2004-0060175

(51) Int. Cl.
*F25B 49/00* (2006.01)

(52) U.S. Cl. ..... 62/126; 62/186; 62/264; 362/23; 362/28; 362/29; 200/310

(58) Field of Classification Search ..... 62/126, 62/176.6, 263, 298, 125, 186, 264, 317; 165/263; 362/23, 24, 28, 29; 200/310, 311, 200/312, 313, 314, 315, 316, 317
See application file for complete search history.

(56) References Cited

U.S. PATENT DOCUMENTS 3,410,105 A * 11/1968 Marsteller ..... 62/125
3,831,663 A * 8/1974 Pithie ..... 165/263
4,041,723 A * 8/1977 Weibel et al. ..... 62/126
4,240,264 A * 12/1980 Nakada et al. ..... 62/125
4,289,272 A * 9/1981 Murase et al. ..... 236/91 D
5,038,577 A * 8/1991 Stanford ..... 62/262
5,045,656 A * 9/1991 Kojima ..... 200/314
5,170,637 A * 12/1992 Shyu ..... 62/176.1
5,192,347 A * 3/1993 Lee ..... 55/359
5,299,430 A * 4/1994 Tsuchiyama ..... 62/180
5,388,426 A * 2/1995 Wada et al. ..... 62/263
5,428,964 A * 7/1995 Lobdell ..... 62/176.6
5,921,094 A * 7/1999 Bang et al. ..... 62/126
6,223,610 B1 * 5/2001 Ishiguro et al. ..... 74/10.41
6,631,619 B2 * 10/2003 Nonaka et al. ..... 62/126
6,968,707 B2 * 11/2005 Violand et al. ..... 62/186
6,997,572 B2 * 2/2006 Ono et al. ..... 362/24
7,040,101 B2 * 5/2006 Takeda et al. ..... 62/264
7,041,922 B2 * 5/2006 Geiger et al. ..... 200/296
7,132,955 B2 * 11/2006 Choi et al. ..... 340/825.52
7,230,196 B2 * 6/2007 Toyama ..... 200/314
7,234,312 B2 * 6/2007 Violand et al. ..... 62/186

(Continued)

FOREIGN PATENT DOCUMENTS

CN 1128339 A 8/1996

(Continued)

*Primary Examiner*—Ljiljana (Lil) V Ciric
(74) *Attorney, Agent, or Firm*—Birch, Stewart, Kolasch & Birch, LLP

(57) ABSTRACT

An air conditioner includes a case having an inlet provided at a front surface thereof to suck in air and an outlet provided at a lower surface thereof to discharge the air, and at least one displaying member provided at an outer border of the inlet so as to display operating information and control operation of the air conditioner.

14 Claims, 12 Drawing Sheets

U.S. PATENT DOCUMENTS

| | | | | |
|---|---|---|---|---|
| 7,266,971 | B2 * | 9/2007 | Kang | 62/317 |
| 7,312,718 | B2 * | 12/2007 | Lenneman et al. | 340/438 |
| 7,350,371 | B2 * | 4/2008 | Lee et al. | 62/317 |
| 2002/0023826 | A1 * | 2/2002 | Miwa et al. | 200/4 |
| 2002/0144513 | A1 * | 10/2002 | Gunji et al. | 62/263 |
| 2002/0189274 | A1 * | 12/2002 | Lee et al. | 62/298 |
| 2004/0003986 | A1 * | 1/2004 | Ito et al. | 200/6 R |
| 2005/0183305 | A1 * | 8/2005 | Hirata et al. | 40/615 |

FOREIGN PATENT DOCUMENTS

| | | | |
|---|---|---|---|
| CN | 1502891 | A | 6/2004 |
| CN | 1508487 | A | 6/2004 |
| JP | 9-196409 | A | 7/1997 |
| JP | 10-96530 | A | 4/1998 |
| JP | 2002-98352 | A | 4/2002 |
| JP | 2002-110003 | A | 4/2002 |
| JP | 2003-65558 | A | 3/2003 |
| KR | 2002084582 | * | 11/2002 |
| KR | 2002084583 | * | 11/2002 |
| KR | 2002088807 | * | 11/2002 |
| KR | 1020030008905 | | 1/2003 |
| KR | 10-0402619 | | 10/2003 |
| KR | 20030096529 | | 12/2003 |

* cited by examiner

AIR CONDITIONER

CROSS-REFERENCE TO RELATED APPLICATIONS

This application claims the benefit of Korean Application No. P2004-58666 filed on Jul. 27, 2004, and P2004-060175 filed on Jul. 30, 2004, which are hereby incorporated by reference as if fully set forth herein.

BACKGROUND OF THE INVENTION

1. Field of the Invention

The present invention relates to an air conditioner, and more particularly, to an air conditioner having a displaying member with an improvement.

2. Discussion of the Related Art

In general, an air conditioner is an apparatus for heating, cooling, or purifying room air so as to make a room environment better. The air conditioner is largely divided into a window type and a split type. The air conditioner that performs cooling and heating the room air uses a heat exchanging process with room air and outside air according to change in a form of refrigerant that flows along a pipe. The air conditioner includes a compressor, a condenser, a capillary tube, and an evaporator. The form of refrigerant is changed according to a thermodynamic cycle, passing through each unit.

In this case, the condenser and the evaporator are included in a heat exchanger for exchanging heat between the refrigerant and air. The window type air conditioner is a system with two heat exchangers respectively working as the condenser and the evaporator and formed as a single body within one frame mounted at a window and so on. The split type air conditioner is named for a system having the two heat exchangers provided respectively at an indoor unit and an outdoor unit. In this case, the indoor unit and the outdoor unit is separately provided and connected with the units via a refrigerant pipe. A controlling member and a displaying member are provided on a front surface of the indoor unit of the air conditioner, and the controlling member is operated by a user so as to operate the air conditioner. During the operation of the air conditioner, the operating state of the air conditioner is displayed by the displaying member.

The air conditioner however has problems as follows.

First, since the displaying member is attached on a front side of the air conditioner, a user is unable to recognize operating information.

Second, since the displaying member and the controlling member are provided as separate devices, it is difficult for a user to easily understand a correlation between the displaying member and the controlling member and to operate the air conditioner, the user who uses the air conditioner for the first time.

In addition, problems are raised that the number of parts consisting the displaying member and the controlling member is increased and that an exterior of the air conditioner on the front side of the air conditioner is not continuous.

SUMMARY OF THE INVENTION

Accordingly, the present invention is directed to an air conditioner that substantially obviates one or more problems due to limitations and disadvantages of the related art.

An object of the present invention is to provide an air conditioner with a displaying member that is more improved.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an air conditioner comprising: a case having an inlet provided at a front surface thereof to suck in air and an outlet provided at a lower surface thereof to discharge the air; and at least one displaying member provided at an outer border of the inlet so as to display operating information and control operation of the air conditioner.

The displaying member comprises: a displaying board supported by an elastic spring so as to be pushed by a user and penetrating light; at least one light emitting part provided at a rear of the displaying board to emit light; ands at least one switch provided at a rear of the displaying board and turned on or off by selectively coming in contact with the displaying board.

The air conditioner further comprises a printed circuit board connected with a lower part of the light emitting part. Desirably, the light emitting part is a light emission diode (LED).

The displaying member further comprises a shielding material for dividing the displaying board into a plurality of light emitting areas. Each of the plurality of light emitting areas divided by the shielding material has a different color and comprises a light emitting part at a lower part of each of the light emitting part such that light is emitted from a part of the plurality of light emitting areas according to an operating state of the air conditioner.

Light may be emitted from a preset number of light emitting parts, the preset number that is preset according to an operating state of the air conditioner.

Meanwhile, the displaying member comprises: a displaying board supported by a rotation axis and penetrating light so as to be rotated by a user; at least one light emitting part provided at a rear of the displaying board to emit light; and a rotary switch provided at the rear of the displaying board and connected with the rotation axis. The air conditioner further comprises a printed circuit board connected with a lower part of the light emitting part. The rotary switch is attached to the printed circuit board.

Desirably, the light emitting part is a light emission diode (LED). The displaying member is provided respectively at both sides of the inlet, and a displaying board of each of the displaying member is formed in a same shape. Light is emitted from a preset number of light emitting parts, the preset number that is preset according to an operating state of the air conditioner.

In this case, the displaying member displays one of a power supplying operation, a purifying operation, and a reserving operation. The displaying member selectively displays at least one of three operating states such as an oxygen-supplying operation, a moisturizing operation and a reserving operation.

The displaying member comprises one hole bored to discharge at least one of oxygen, humid air and outside air. The inlet is selectively opened or closed by a front panel. An auxiliary inlet is formed on an upper surface of the case, and a suction grill is detachably provided at the auxiliary inlet.

Meanwhile, in another aspect of the present invention, an air conditioner comprises a case having an inlet formed on a front surface thereof to suck in air, and an outlet formed on a lower surface thereof to discharge the air; a first displaying member provided at a first border of the inlet to display operating information of the air conditioner and having a switch pressed by a user to control an operation; and at least one second displaying member provided at a second border of the inlet to display operating information of the air conditioner and having a rotary switch rotated by a user to control an operation.

The first displaying member further comprises: a displaying board supported by an elastic spring so as to be pushed by a user and penetrating light; and at least one light emitting part provided at a rear of the displaying board to emit light, wherein, the switch is provided at the rear of the displaying board and turned on or off by selectively coming into contact with the displaying board.

The second displaying board further comprises a displaying board supported by an elastic spring so as to be pushed by a user and penetrating light; and at least one light emitting part provided at a rear of the displaying board to emit light, in this case, the rotary switch is provided at the rear of the displaying board and connected with the rotation axis.

The first displaying member displays and controls power supply of the air conditioner, and a kind of the operating mode, and the second displaying member displays and controls strength and weakness of the operation state of the air conditioner.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
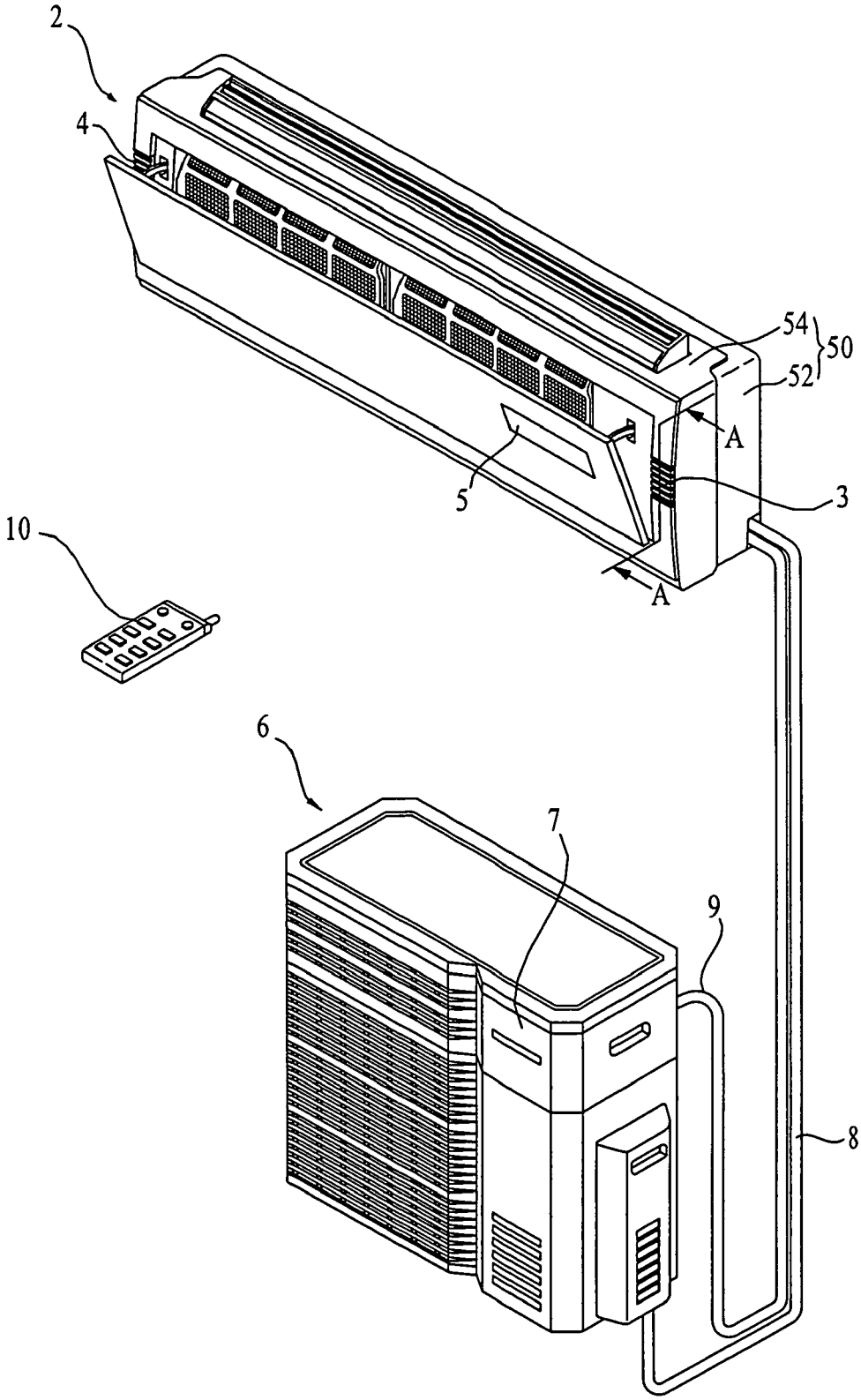
FIG. 1 illustrates a perspective view showing an air conditioner in accordance with a first embodiment of the present invention.

Referring to FIGS. 1 to 13, an air conditioner in accordance with each embodiment of the present invention will be described concretely hereinafter. FIG. 1 illustrates a perspective view showing an air conditioner in accordance with a first embodiment of the present invention. As illustrated in FIG. 1, the air conditioner includes an indoor unit 2 and an outdoor unit 6 spatially separated from each other. The indoor unit 2 and the outdoor unit 6 are coupled with each other by a refrigerant pipe 8 through which refrigerant is passed.

An inlet for sucking in air is formed on a front surface of a case including an exterior of the indoor unit 2, and an outlet is provided on a bottom surface thereof. A plurality of displaying members 3, 4, and 5 is provided at a border on the front side of the inlet to display operating information.

An indoor heat exchanger for exchanging heat with room air and an indoor fan for blowing the room air are provided in the indoor unit 2. A compressor, an outdoor fan, an outdoor heat exchanger, and a channel switching valve are provided in the outdoor unit 6.

In this case, the refrigerant passing through the inside of the indoor heat exchanger and the outdoor heat exchanger respectively exchanges heat with the room air and the outdoor air. An expanding device is provided at one of the indoor unit 2 and the outdoor unit 6 to expand the refrigerant between the indoor heat exchanger and the outdoor heat exchanger.

Meanwhile, the outdoor unit 6 is provided with an oxygen supplying device 7 for supplying fresh air from outside of the indoor unit 2 to the indoor unit 2. A guiding hose 9 for guiding fresh air generated from the supplying device 7 is provided between the indoor unit 2 and the outdoor unit 6. The oxygen supplying device 7 may generate oxygen, or perform adding proper moisture to the fresh air after the fresh air from outside is purified.

Operation of the air conditioner is controlled by a controller, and the air conditioner receives signals generated from the controller so as to perform operations for cooling, heating, dehumidifying, purifying, generating oxygen, humidifying, and ventilating. Accordingly, temperature, humidity, and amount of oxygen in the room are controlled by the air conditioner. Meanwhile, a case 50 including exterior of the indoor unit includes sash and a front frame. The sash 52 covers the rear of the indoor unit, and has a front frame 54 coupled thereto in front thereof. The sash 52 and the front frame 54 may be formed as a single body. A fan and an indoor heat exchanger are accommodated in the case 50.

Figure 2:
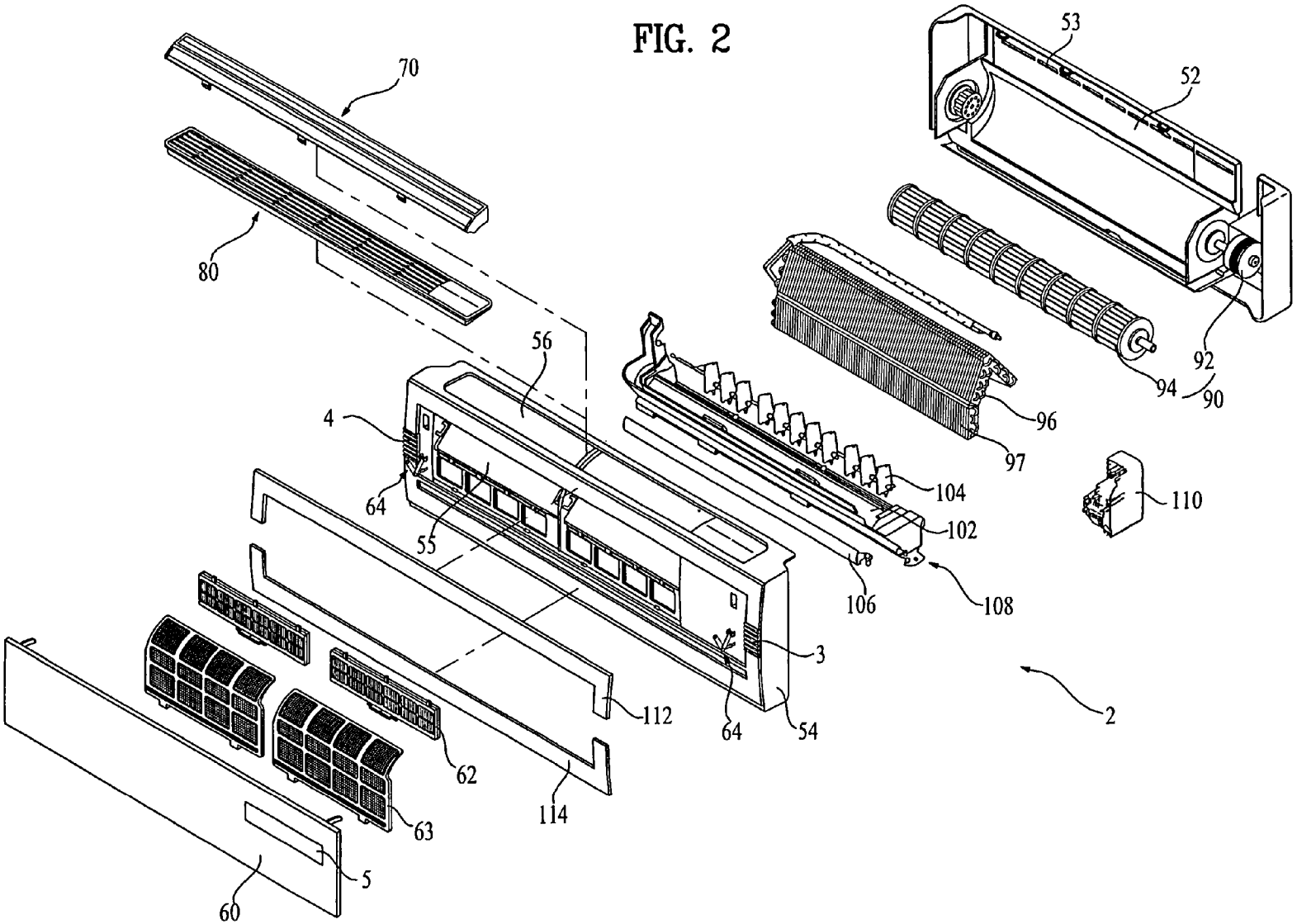
FIG. 2 illustrates a schematic perspective view of an air conditioner in accordance with the present invention.

FIG. 2 illustrates a schematic perspective view of an air conditioner in accordance with the present invention. As shown in FIG. 2, an inlet 55 for receiving room air is formed on a front side of the front frame, and an auxiliary inlet 56 is formed on an upper surface of the sash 52. Desirably, a rear inlet 53 is formed at the rear of the sash 52.

An outlet (not shown) through which conditioned air is discharged is formed at a lower surface of the case 50. A fan 94 and a heat exchanger 96 are provided in the case 50, and a control box 110 for controlling the air conditioner is provided at a side of the heat exchanger 96.

An electric dust collector 62 and a free filter 63 are provided at rear of the inlet 55. A front panel 60 for opening and closing the inlet 55 is rotatably provided in front of the front frame 54. Both sides of the lower part of the front panel 60 is coupled with the front frame 54 via a link means 64.

Figure 3:
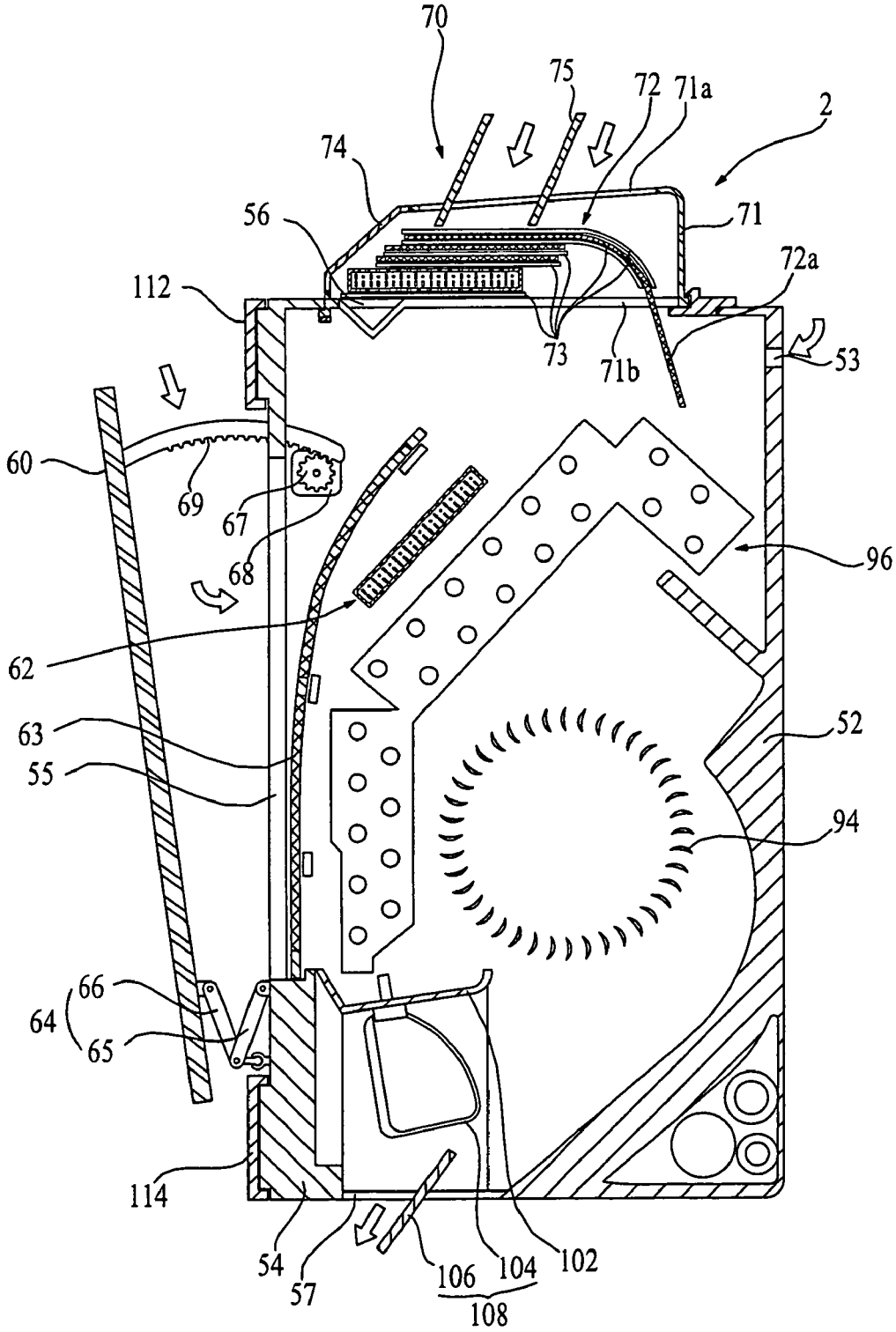
FIGS. 3 and 4 illustrate cross sectional views each showing the air conditioner in accordance with the present invention.
Figure 4:
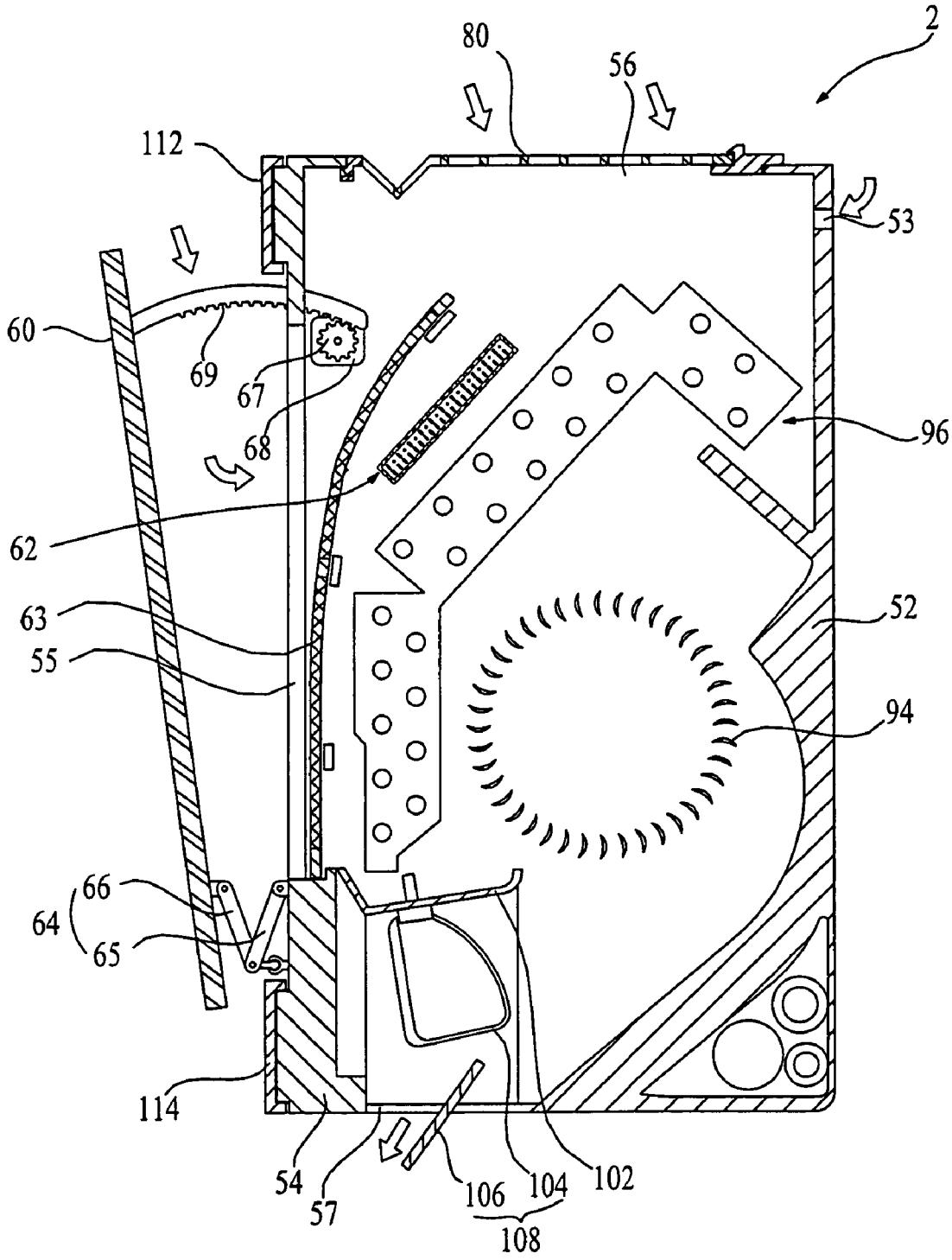

FIGS. 3 and 4 illustrate a cross sectional view of an air conditioner in accordance with the present invention. As shown in FIG. 3, the link means 64 includes a first link 65 coupled with a front surface of the front frame 54, and a second link 66 coupled with a rear surface of the front panel 60.

Meanwhile, a rack 69 coupled with a pinion 67 is provided inside of the front frame 54 so as to rotate the front panel 60. When the pinion 67 is rotated by driving a motor 68, the front panel coupled with the rack 69 is rotated and selectively opens or closes the inlet 55.

A mirror, a frame, or a panel in a particular color is attached to a front surface of the front panel 60. A displaying device 5 such as an LCD may be provided on the front surface. Desirably, operating information or images of the air conditioner is displayed through the displaying device 5.

As shown in FIGS. 3 and 4, a filter unit 70 or a suction grill 80 is detachably provided at the auxiliary inlet 56 formed on the upper surface of the front frame 54. When the filter unit 70 is provided, air sucked from the auxiliary inlet 56 is purified passing through the filter unit 70. When the suction grill 80 is attached, the assembling structure of the air conditioner is simple and economical.

Meanwhile, the filter unit 70 includes a filter case 71 having a suction hole 71*a* and a communication hole 71*b* formed thereat for sucking in the room air, and at least one filter 72 attached to the filter case 71. The filter case 71 is provided with a guide 73 for guiding insertion of the filter 72. The filter 72 includes a free filter, an electric dust collector, a HEPA filter, a NANO copper filter, and a NANO silver filter.

To make it easier to insert the filter 72, a front cover 74 which is detachable is provided on a front surface of the filter case 71. A plurality of louvers 75 is rotatably provided so as to change the direction of the air sucked into the suction hole 65*a*. Flow of the air in the indoor unit will be described as follows. First, when the fan 94 is driven, room air is sucked into the indoor unit through the inlet 55 and the auxiliary inlet, and the air sucked in is passed through the filters and purified. The purified air exchanges heat, passing through the heat exchanger 96. In this case, the fan 94 desirably includes a cross flow fan which is arranged long along a right and left direction in front of the sash 52. Further, the heat exchanger 96 is provided in a bent form so as to equally come in contact with the air. The air exchanged heat is discharged into the room through the outlet 57 at the bottom. A condensed water receiver 102 for receiving condensed water is provided at a lower inner part of the front frame 54. A discharging unit 108 is provided at an upper part of the outlet 57, the discharging unit 108 including a louver 104 for changing a left and right direction of the air which is discharged, and a vein 106 for changing an upper and down direction of the air are provided.

Decorating panels 112 and 114 is provided respectively at upper and lower borders of the inlet 55.

As shown in FIGS. 1 and 2, at least one of displaying member 3 and 4 is provided at an outer border of the inlet 55. In this case, the displaying members 3 and 4 are provided for displaying the operating information of the air conditioner and controlling the operation thereof.

Figure 5:
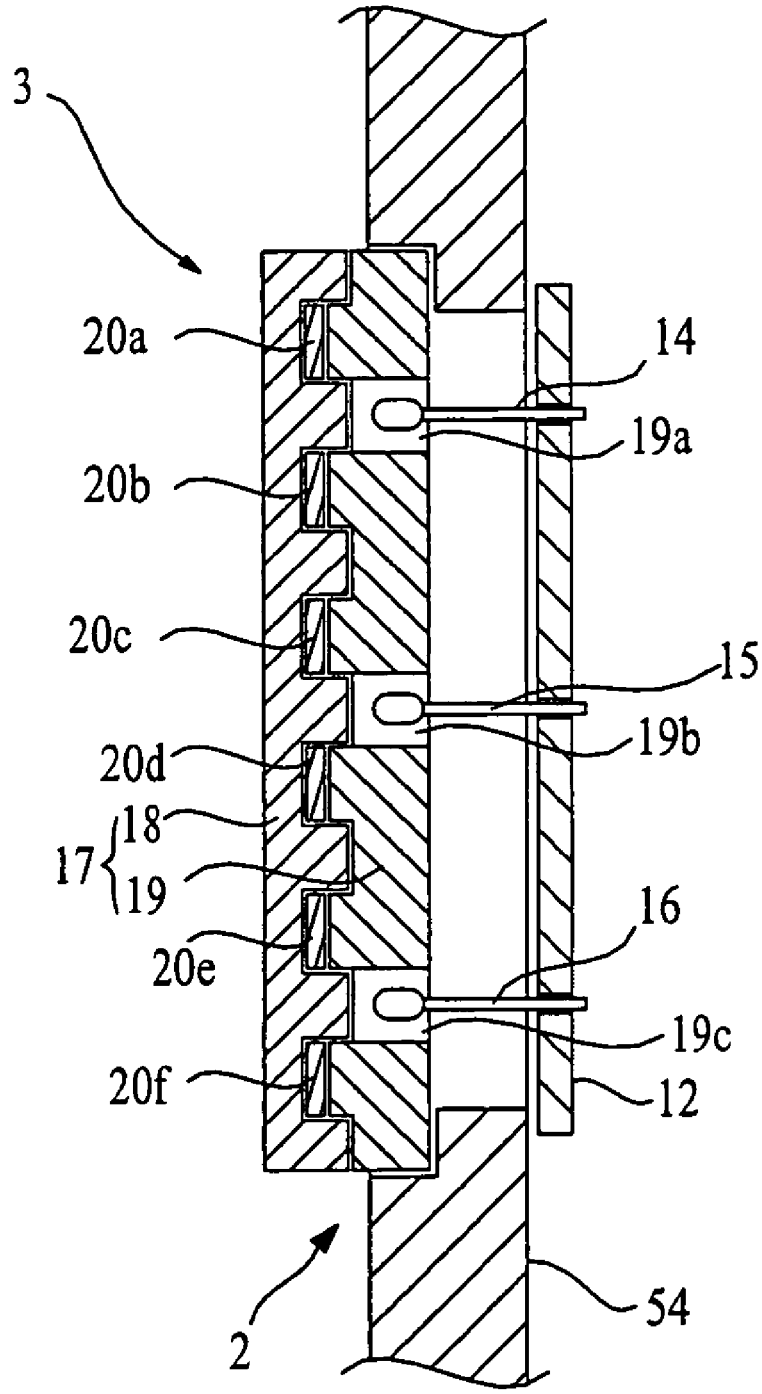
FIGS. 5 to 9 illustrate cross sectional views each showing a displaying member in accordance with each embodiment of the present invention.

FIGS. 5 to 9 are each embodiment of the displaying member of the present invention and illustrate cross sectional views taken from A-A direction of FIG. 1. FIG. 5 is a drawing for describing a structure of the displaying member that displays an operating conditioner of the air conditioner.

As shown in FIG. 5, the displaying members 3 and 4 display operating conditioner of the air conditioner. For this reason, each of the displaying members 3 and 4 includes a displaying board 17 and a plurality of light emitting parts 14, 15 and 16.

The displaying board 17 is made of a transparent material and includes the light emitting parts at a lower part thereof. Accordingly, a light radiated from each of the light emitting parts is seen from outside though the displaying board.

Each of the plurality of light emitting parts 14, 15 and 16 displays a state according to a power supplying operation, a purifying operation, and a reserving operation. When the plurality of displaying members is provided, one of the displaying members may display a state according to an oxygen-supplying operation, a humidifying operation, and a ventilating operation. In this case, the light emitting parts 14, 15 and 16 desirably include a light emission diode (LED).

Referring to FIGS. 1 and 2, the displaying member 3 and 4 are desirably provided at both sides of the inlet 55 of the air conditioner. In this case, to improve the exterior of the air conditioner, the displaying board 17 of each of the displaying members is desirably formed in a same shape.

Meanwhile, the displaying board 17 includes a transparent material 18 and a shielding material. The shielding material divides the transparent material 18 into a plurality of light emitting areas on which lights emitted from each of the light emitting materials are displayed independently. In this case, the shielding material and an opaque material 19 include shielding films 20*a*, 20*b*, 20*c*, 20*d*, 20*e* and 20*f*. The opaque material 19 includes pass through holes 19*a*, 19*b*, and 19*c* through which lights emitted from the light emitting parts 14, 15 and 16 are passed. The shielding films 20*a*, 20*b*, 20*c*, 20*d*, 20*e* and 20*f* are provided between the displaying board 17 and the opaque material 19 so as to divide the light emitting areas of the displaying board 17.

Desirably, each of the light emitting areas divided by the shielding material has a different color. In this case, each of the light emitting parts 14, 15 and 16 is provided at a lower part of each of the light emitting areas, and light is emitted from a part of the light emitting parts according to the operating state. In this instance, a user sees a different color according to an operating state of the air conditioner.

In other words, since the light emitting parts 14, 15 and 16 represent respectively a power supply, a purifying operation, and a reservation, the user is able to understand the operating state of the air conditioner through the light emitted from one of the light emitting part. When each area of the displaying board has a different color from each other, the operating state of the air conditioner is more easily understood.

When a plurality of displaying members is provided, the user can understand various operating states of the air conditioner through each of the plurality displaying members. Meanwhile, the displaying member may be configured to emit lights from a preset number of light emitting parts, the preset number corresponding to the different operating states of the air conditioner. In this case, the user may grasp the operating state of the air conditioner by the number of the lights recognized.

Figure 6:
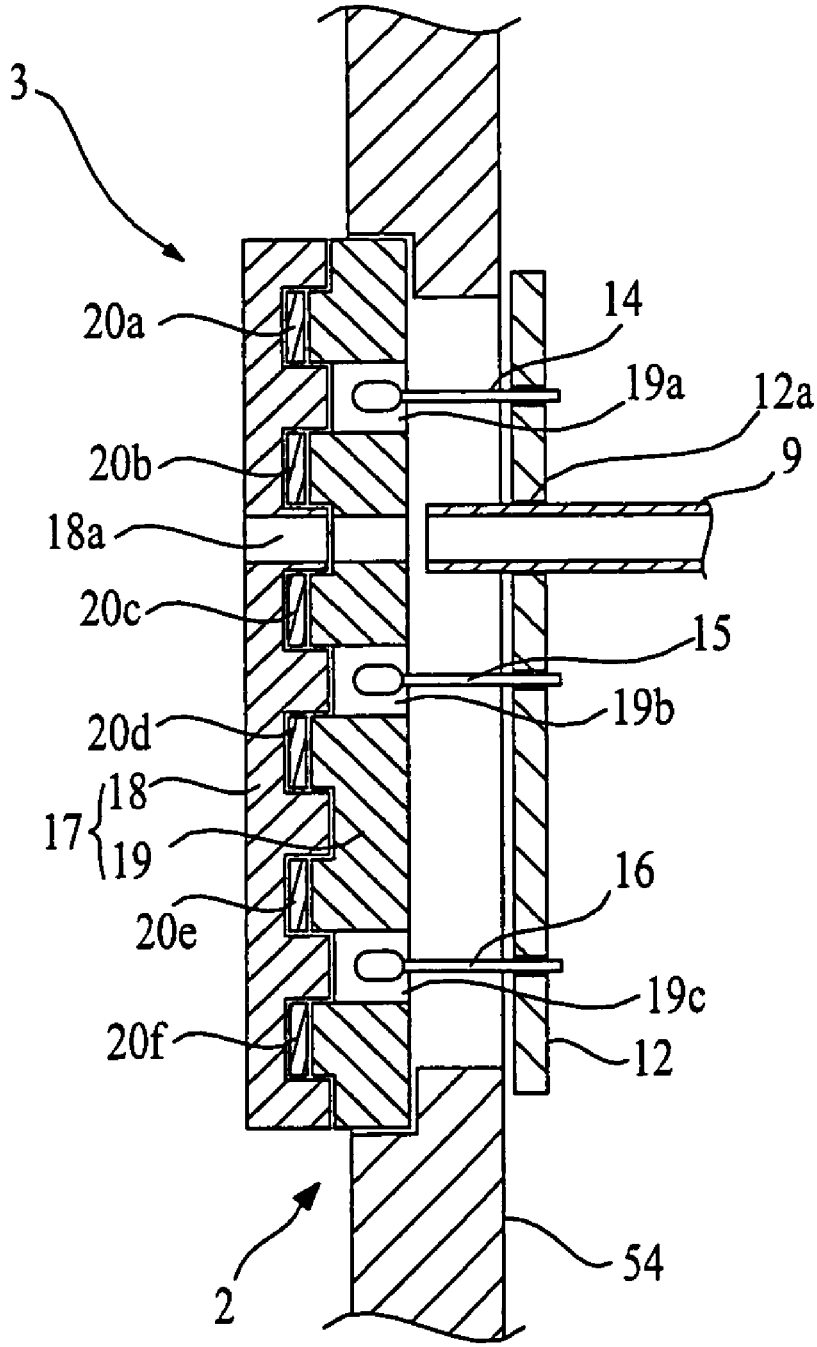

Meanwhile, as shown in FIG. 6, the displaying members 3 and 4 are configured to have a hole for discharging at least one of oxygen, humid air, and outside air. In other words, holes 18*a* and 12*a* are formed to pass through the displaying board 17 and a printed circuit board 12, and the hole 12*a* formed on the printed circuit board is provided with a guiding pipe 9 through which fresh outside air is passed.

Accordingly, when the oxygen-supplying operation is selected through the controller, the oxygen supplying device provided at the outdoor unit is driven. Air containing oxygen generated from the oxygen supplying device is moved through the guiding pipe 9 and then discharged into the room through the hole 18*a* formed on the displaying member.

Figure 7:
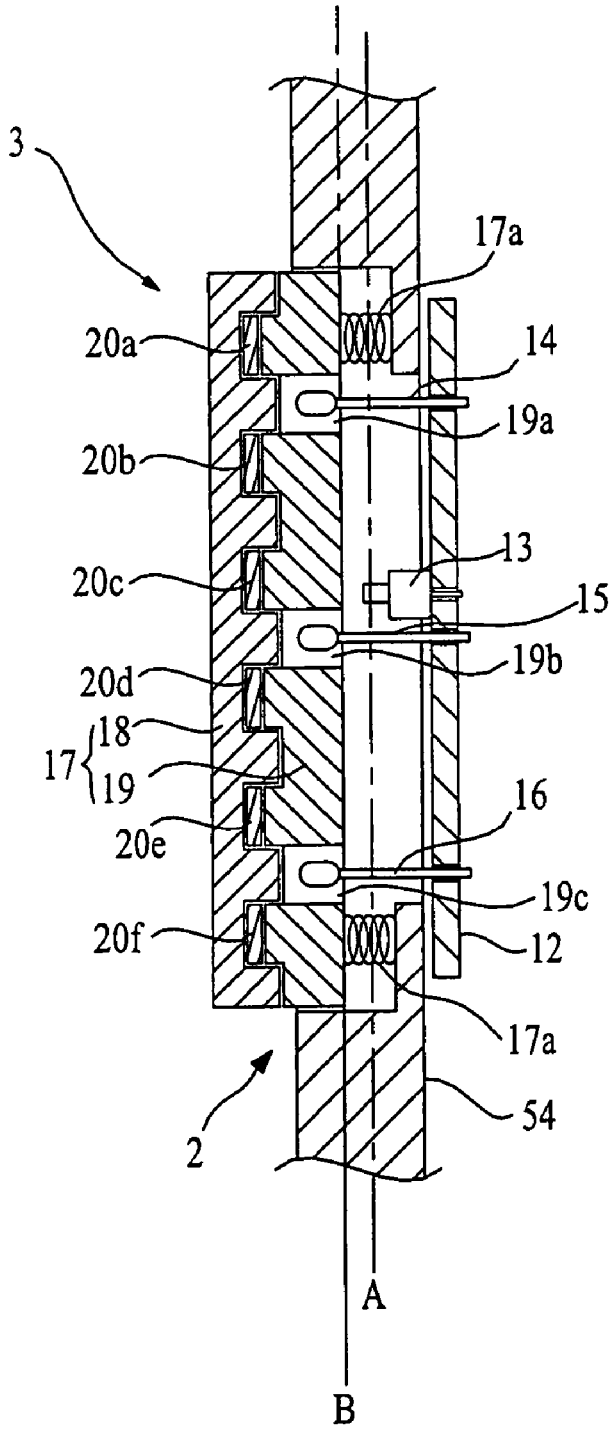
Figure 8:
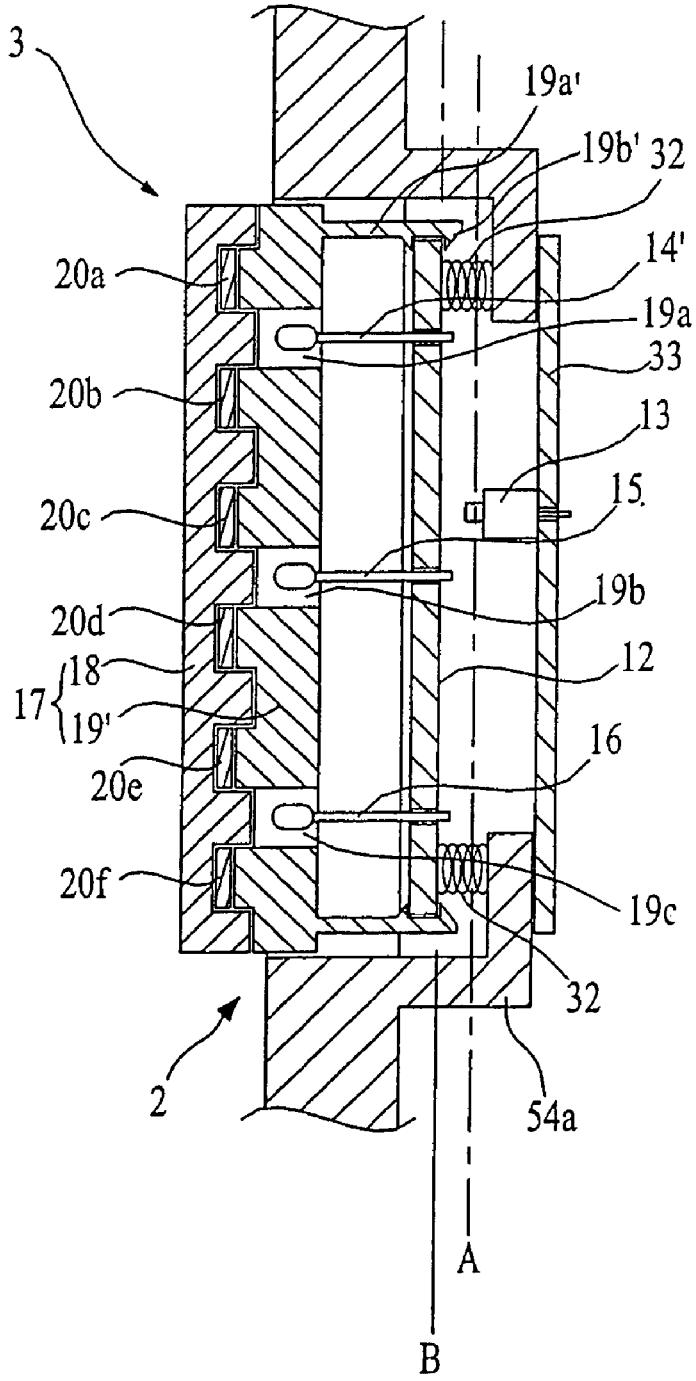
Figure 9:
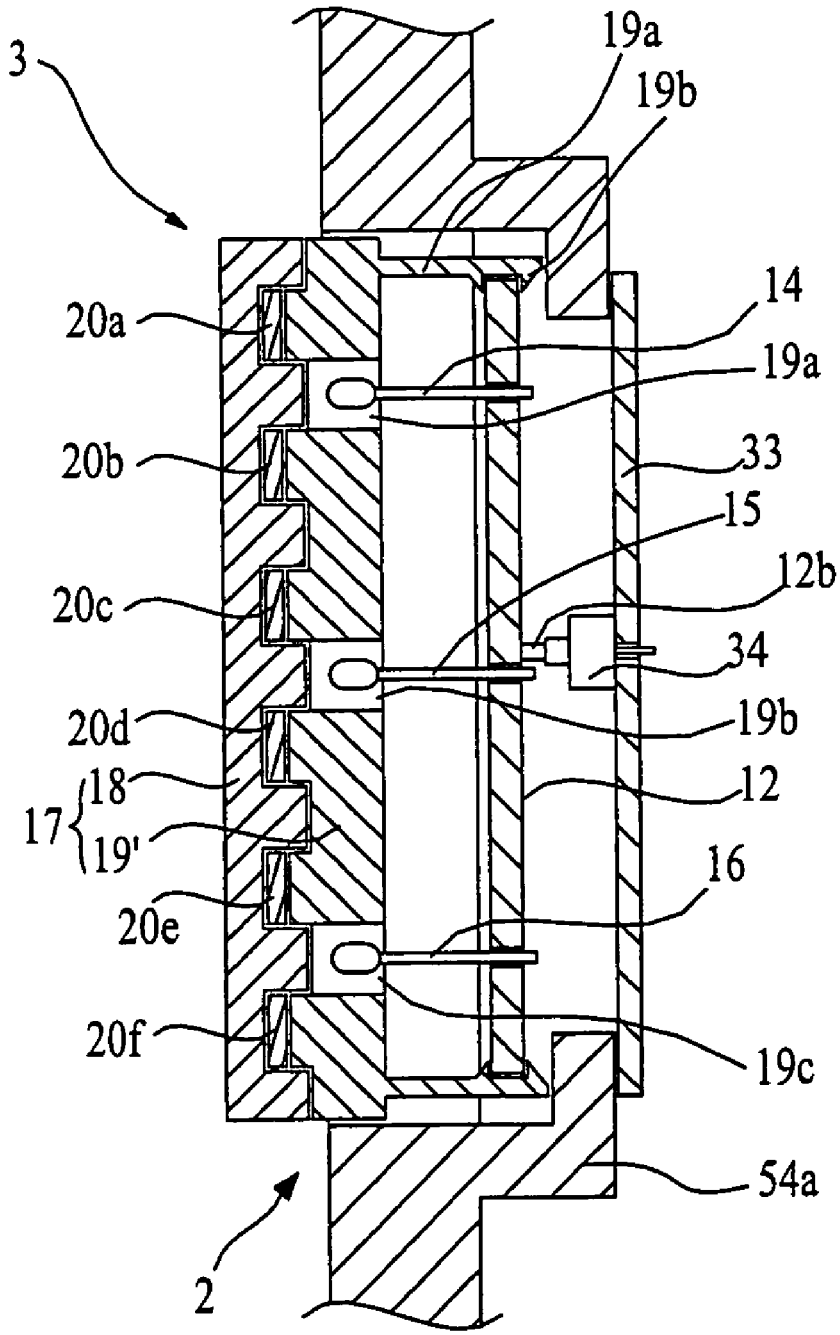

FIGS. 7 to 9 are drawings for describing operation of the air conditioner through the displaying member in accordance with each embodiment of the present invention. As shown in FIG. 7, the displaying members 3 and 4 in accordance with a first embodiment of the present invention include a displaying board 17, light emitting parts 14, 15 and 16, and at least one switch 13.

In this case, the displaying board 17 is supported by an elastic spring 17*a* so as to be pushed by the user. Light emitting parts 14, 15 and 16 are provided at a rear of the displaying board 17. A shielding material is provided at a lower part of the displaying board 17, and lights emitted from each of the light emitting part are displayed separately.

Meanwhile, a switch 13 for controlling the operation of the air conditioner is provided at a rear of the displaying board 17. The switch 13 comes in contact with the displaying board 17 selectively so as to be on and off.

Accordingly, when the user pushes the rear of the displaying board 17, a spring 17*a* that supports the rear of the displaying board 17 is compressed. In this instance, when the displaying board 17 reached to a switching position (A), the switch 13 comes in contact with the displaying board 17 and switched on. Thereafter, when the pressured on the displaying board 17 is released, the displaying board 17 is restored to an original place (B).

The switch 13 is electrically connected with the printed circuit board 12 connected with a control box, and the operation of the air conditioner is controlled by manipulating the switch 13. In this instance, displaying the operating state of the air conditioner through the displaying members 3 and 4 is the same as mentioned above with reference to FIG. 5.

Meanwhile, the displaying board 17

As shown in FIG. 8, the displaying board 17 may be detachably provided. In this case, the light emitting parts 14, 15 and 16 are mounted at a first printed circuit board 12, and the first printed circuit board 12 is detachably coupled with the displaying board 17. In this case, an extending member 19*a*' is provided at both ends of the displaying board 17, and a hook 19*b*' is provided at an end of the extending member 19*a*'. Accordingly, both ends of the first printed circuit board 12 are detachably coupled with the hook 19*b*'.

In this case, the front frame 54 is provided with a supporting member 54*a* recessed therein, and the supporting member 54*a* is coupled with the elastic spring 32. The elastic spring 32 is coupled with a rear of the first printed circuit board 12.

A second printed circuit board 33 is provided at a rear of the first printed circuit board 12, and the second printed circuit board 33 is fixed on a rear surface of the supporting member 54*a*. In this case, the second printed circuit board 33 is provided with the switch 13 in front thereof.

In this case, when the user presses the displaying board 17, the displaying board 17 and the first printed circuit board 12 are moved rearward at the same time. In this case, the rear of the first printed circuit board 12 is supported by the elastic spring 32. Accordingly, the first printed circuit board 12 is moved between the switching position (A) and the original position (B). Accordingly, the switch 13 is switched according to a choice of the user. As shown in FIG. 9, the displaying members 3 and 4 in accordance with the present invention include a displaying board 17, light emitting parts 14, 15 and 16, and a rotary switch 34.

In this case, the displaying board 17 is supported by a rotation shaft 12*b* so as to be rotated by the user. The light emitting parts 14, 15 and 16 are provided at a rear of the displaying board 17. The lights emitted from the light emitting parts are radiated to an outside thereof through the displaying board 17. In this case, displaying the operating state of the air conditioner through the displaying board is the same as mentioned above with reference to FIG. 5.

Meanwhile, the rotary switch 34 is an apparatus for transmitting signals to a control box, the signals generated according to the rotation of the rotation shaft 12*b* connected to the rotary switch 34. The rotary switch 34 is disposed on the second printed circuit board 33 provided in the rear of the displaying board 17. In this case, the rotary switch 34 is connected with the displaying board 17 via the rotation shaft 12*b*.

As illustrated, the rotation shaft 12*b* may be connected with the first printed circuit board 12 or the displaying board 17 provided at the rear of the displaying board 17. In this case, when the user rotates the displaying board 17, the rotation shaft 12*b* connected with the rotary switch 34 is also rotated. In this instance, the signals generated from the rotary switch 34 are transmitted to the control box so as to control the operation of the air conditioner.

In general, the rotary switch 34 is employed for controlling the amount of air flow and the amount of heat transfer for cooling or heating, in an operating condition.

Accordingly, the displaying member in accordance with a second embodiment is employed for displaying the operating state of the air conditioner and also for controlling strength and weakness of each operating state.

Meanwhile, the air conditioner is provided with a plurality of displaying members. In this case, the displaying members provided at a border of the inlet 55 display the operating information of the air conditioner and also control the operation of the air conditioner through manipulation of the user.

Desirably, at least one of the displaying members includes a first displaying member including the switch, and all others are a second displaying member including the rotary switch.

As shown in FIGS. 7 and 8, the first displaying member comprises the displaying board 17 and the switch 13, and the operation of the air conditioner is controlled by applying pressure on the displaying board 17 such that the displaying board 17 comes in contact with the switch 13.

Accordingly, the first displaying member is desirably employed for supplying power to the air conditioner, and displaying and controlling a kind of the operating mode of the air conditioner.

As shown in FIG. 9, the second displaying member comprises the displaying board 17 and the rotary switch 34, and the operation of the air conditioner is controlled by rotating the displaying board 17 connected with the rotary switch 34. Accordingly, the second displaying member is desirably employed for displaying and controlling the strength and weakness of the operating state of the air conditioner.

When the air conditioner includes the first and second displaying members, the exterior of the air conditioner is improved, and also the operating state is displayed and controlled in more various ways. The displaying members are enabled to display and control the operating state in a more compact space, and therefore, a narrow space of the border of the inlet is more effectively utilized.

Figure 10:
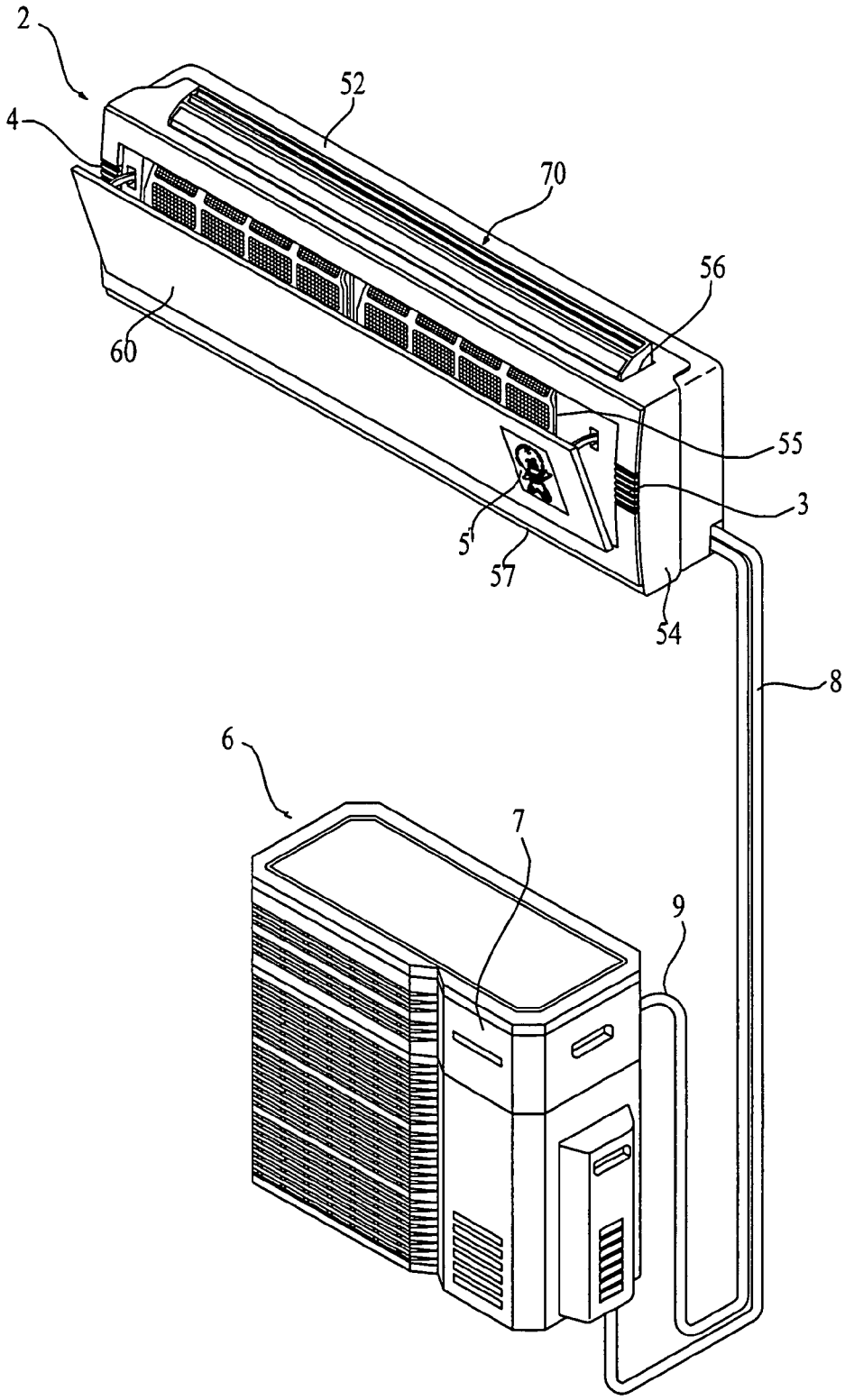
FIGS. 10 and 11 illustrate perspective views each showing an air conditioner in accordance with a second embodiment of the present invention.
Figure 11:
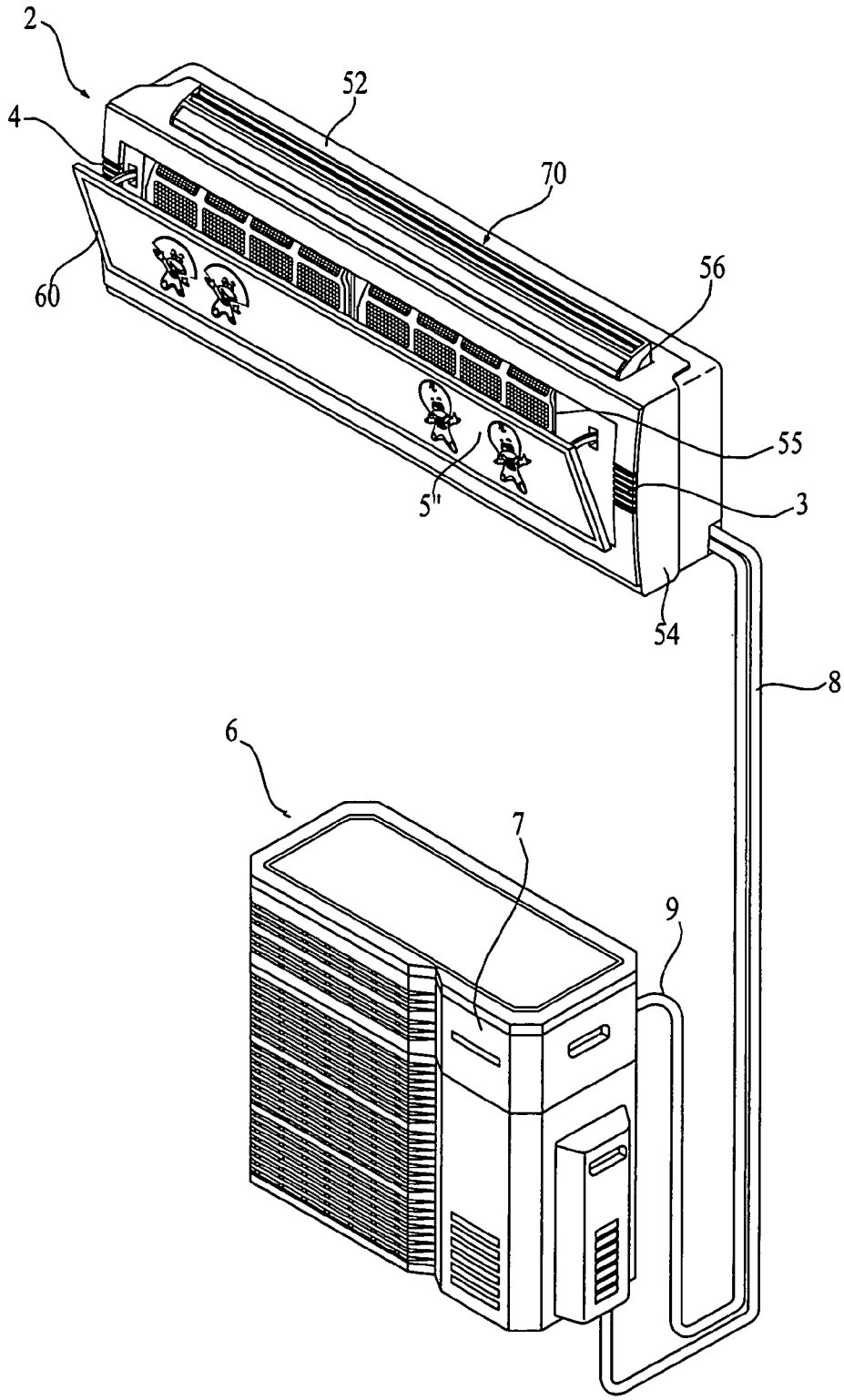

FIGS. 10 and 11 illustrate an exterior of the air conditioner in accordance with the present invention. As shown in FIG. 10, a displaying member 5' for displaying an avatar is provided on a front side of the front panel 60 that opens or closes the inlet 55 of the indoor unit of the air conditioner.

Meanwhile, as shown in FIG. 11, the whole front surface of the front panel 60 may be provided as a displaying member 5", and the displaying member 5" displays the avatar or the operating state of the air conditioner.

Figure 12:
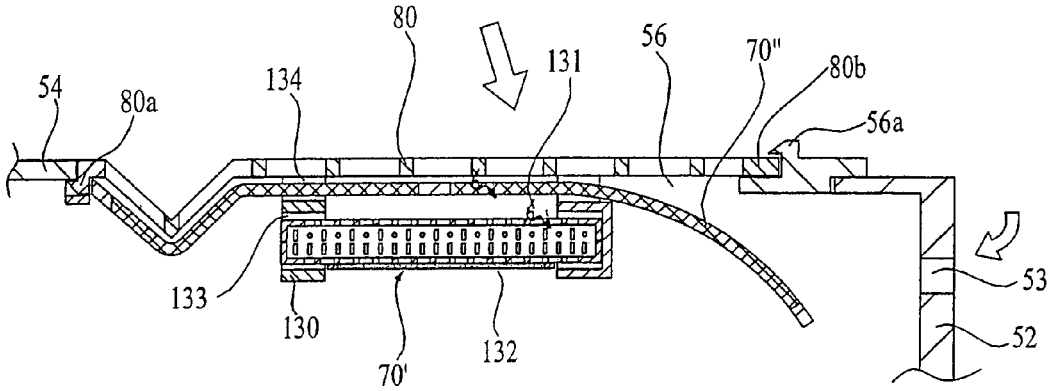
FIG. 12 illustrates a cross sectional view showing a structure of an auxiliary inlet in accordance with the second embodiment of the present invention.
Figure 13:
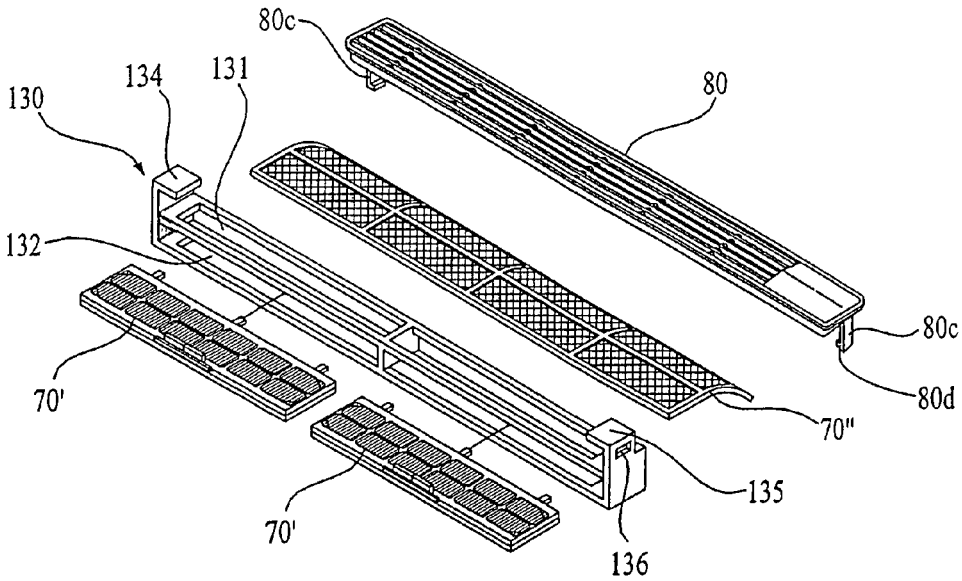
FIG. 13 illustrates a schematic view of a suction panel and a filter unit mounted at the auxiliary inlet in accordance with the second embodiment.

FIG. 12 illustrates a cross sectional view showing an upper part of the indoor unit of the air conditioner in accordance with the second embodiment of the present invention, and FIG. 13 illustrates a schematic perspective view showing the upper part of the indoor unit.

As shown in FIGS. 12 and 13, a suction grill 80 is detachably provided at the auxiliary inlet 56 formed on an upper surface of the case of the indoor unit, and a filter unit 70' is detachably provided at the suction grill 80.

As shown in FIG. 12, the suction grill 80 is detachably fixed on an upper surface of the front frame 54 by a hook coupling. In other words, a first end 80*a* of the suction grill 80 is inserted into a lower side of the border of the auxiliary inlet 56, and a second end 80*b* is coupled with a hook 56*c* provided at the border of the auxiliary inlet. In this case, other structural elements except the suction grill 80 and the filter unit 70' are the same as the first embodiment of the indoor unit in accordance with the present invention.

The filter unit 70' includes at least one electric dust collector, a HEPA filter, a NANO carbon filter, a NANO copper filter, and a NANO silver filter. A plurality of the filter unit 70' may of course be provided in an up and down direction or a right and left direction.

For example, the upper filter unit may be configured to include the HEPA filter, the NANO carbon filter, an assemblage of a filter case, and an electric dust collector, and the lower filter unit may be configured to include the NANO copper filter, the NANO silver filter, and the assemblage of the filter case.

Meanwhile, a filter frame 130 is detachably provided at a lower part of the suction grill 80. An upper surface 131 and a lower surface 132 of the filter frame 130 are opened such that the air passed through the suction grill 80 is passed. The front surface of the filter frame 130 is opened so as to slide and insert the filter unit 70' therein.

Guide protrusions 134 and 135 for guiding insertion of a free filter 70" is formed in an 'L' shape and protruded from both upper sides of the filter frame 130. In this case, the filter frame 130 is detachably fixed on a lower surface of the suction grill 80 by a coupling means such as a hook.

In other words, an extending member 80*c* having a hook 80*d* at an end thereof is extended from both sides of the suction grill 80, and the hook 80*d* is inserted and fixed in a catching groove 136 formed on both sides of the filter frame 130.

Operation of the air conditioner in accordance with the present invention as mentioned above will be described as follows referring to FIGS. 1 to 13. First, when power is inputted into the air conditioner by manipulating the controller 10, lights are radiated from one of the plurality of light emitting parts 14, 15 and 16 provided at the displaying members 3 and 4. The radiated light notifies the user that the power is supplied to the air conditioner through the displaying board 17.

In addition, when at least one of cooling, heating, and dehumidifying operations is selected though the controller 10, the air conditioner controls the indoor unit and the outdoor unit according to a selected operating command. In this instance, lights are radiated from one of the plurality of light emitting parts 14, 15 and 16 provided at the displaying members 3 and 4, the one corresponding to the selected operation command. Through this, the user can understand that a desired operating command is selected.

In this case, when the cooling operation is selected, a channel switching valve provided at the outdoor unit is switched to a cooling mode. On the other hand, when a heating mode is selected, the channel switching valve is switched to a heating mode. Thereafter, a compressor provided at the outdoor unit is driven, and refrigerant is circulated along pipes provided at the indoor unit and the outdoor unit.

As shown in FIGS. 3 and 4, when a pinion 67 connected with the motor 68 is rotated, the rack 69 is moved forward. In this instance, the front panel 60 is rotated about the link means 64, and the inlet 55 is opened. Thereafter, when the indoor fan 94 is rotated, room air is sucked into the room through the inlet 55.

In this case, the room air is sucked in through the inlet 55 and the auxiliary inlet 56 provided respectively on front and upper surfaces of the case of the indoor unit. The air sucked in through the inlet 55 is purified passing through a dust collector on a front side thereof, and a filter 63, and the air sucked in through the auxiliary inlet 56 is purified passing through the filter units 70 and 70'.

After the purified air is cooled or heated passing through the heat exchanger 96, the air is guided by a louver 104 and a vein 106, and discharged through the outlet 57 to the room.

Meanwhile, when the dehumidifying operation is selected through the controller 10, the channel switching valve is changed to a cooling mode, and the indoor fan 94 is rotated at a speed lower than during the cooling operation. Lights are radiated from a light emitting part corresponding to the dehumidifying operation, among the plurality of light emitting parts 14, 15 and 16. In this case, during the dehumidifying operation, operation of the compressor and flowing of the room air are the same as during the cooling operation.

Meanwhile, when the purifying operation is selected through the controller 10, the compressor and the fan of the outdoor unit 6 are not driven, but only the fan 94 of the indoor fan 94 is driven. Accordingly, the room air is purified passing through the filter 63 provided at the rear of the inlet 55 and the filter units 70 and 70' provided at the auxiliary inlet 56, and then discharged back to the room. In this instance, light is radiated from a light emitting part corresponding to the purifying operation, among the plurality of light emitting parts 14, 15 and 16 provided at the displaying member 3.

The inlet 55 is closed during the purifying operation, and only the auxiliary inlet 56 is operated in an opened state. In this instance, the air sucked in is purified to be cleaner, passing through the filter units 70 and 70' provided at the auxiliary inlet 56.

Besides, in case that a reserving operation, an oxygen-supplying operation, a moisture adding operation, or a ventilating operation is selected, light is radiated from a light emitting part corresponding to a selected operation through the displaying member. Therefore, the user can understand that the air conditioner is being operated in a mode the user desired.

Meanwhile, when the air conditioner is stopped from operating via the controller in the middle of any operation, the compressor and the fans are stopped. When the pinion 67 connected with the motor is rotated in a reverse direction, and the rack 69 is moved rearward, the front panel 60 is rotated about the link means 64 so as to close the inlet 55.

As shown in FIGS. 7 to 9, the displaying member not only displays the operating information of the air conditioner but also controls the operation of the air conditioner. For this reason, the displaying member includes a switch 13 or a rotary switch 34 at a lower part thereof. Accordingly, without controlling the controller 10, the operation of the air conditioner is controlled by pressing or rotating the displaying members 3 and 4.

In this case, the power supplying operation, the cooling operation, the heating operation, and the purifying operation may be turned on or off according to the number of pressing the switch. The air conditioner may also be controlled by assembled manipulation of the switches provided at a lower part of the plurality of displaying members. In addition, according to a rotation degree of the rotary switch 34 rotated by the user, the strength and weakness of the operation of the air conditioner may be controlled.

The air conditioner in accordance with the present invention has advantages as follows.

First, since an operating state of the air conditioner is displayed through a plurality of displaying members in various ways, a user can easily recognize the operating information of the air conditioner even from a distance.

Second, since the displaying member is provided to be able to display the operating state of the air conditioner and at the same time to control the operation of the air conditioner, a space provided at a border of the inlet is more effectively used, and the air conditioner is maintained to have a beautiful exterior.

Third, since the displaying member is divided into areas each having a different color and lit up by a light emitting part, the user can easily recognize various operating states. In addition, the beauty of the exterior is improved.

Fourth, at least one of a plurality of displaying members includes one rotary switch, the operating state is displayed by rotating the rotary displaying member, and the strength and weakness of the operation of the air conditioner are controlled at the same time.

Fifth, since fresh air is discharged through at least one of the plurality of displaying members and there is no need to provide a separate air supplying hole at the border of the inlet, the exterior of the air conditioner is improved.

Sixth, since a suction grill and a filter unit is detachably provided at an auxiliary inlet provided at an upper surface of the air conditioner, the filter unit is easily cleaned and exchanged.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An air conditioner comprising:

a case having an inlet provided at a front surface thereof to suck in air and an outlet provided at a lower surface thereof to discharge the air; and at least one displaying member provided at an outer border of the inlet so as to display operating information of the air conditioner and to control operation of the air conditioner therethrough, wherein the at least one displaying member includes a rotary switch to allow a user to input a command for operating the air conditioner;

at least one light emitting part to emit light according to the operating information of the air conditioner;

a rotation shaft rotating on an axis thereof and connected with the rotary switch; and a displaying board provided in front of the at least one light emitting part to allow the light from the at least one light emitting part to pass therethrough to display the operating information, provided in front of the rotary switch and coupled with the rotation shaft so as to allow the user to input the command by rotating the displaying board, wherein the displaying board is rotatable on a plane parallel to the front surface of the case.

2. The air conditioner of claim 1, further comprises a printed circuit board connected with a lower part of the at least one light emitting part.

3. The air conditioner of claim 2, wherein the rotary switch is attached to the printed circuit board.

4. The air conditioner of claim 1, wherein the at least one light emitting part is a light emission diode (LED).

5. The air conditioner of claim 1, wherein the at least one displaying member includes a plurality of displaying members, the plurality of displaying members are provided respectively at both sides of the inlet, and the displaying board of each of the plurality of displaying members is formed in a same shape.

6. The air conditioner of claim 1, the at least one displaying member further comprises a shielding material for dividing the displaying board into a plurality of light emitting areas.

7. The air conditioner of claim 6, wherein each of the plurality of light emitting areas divided by the shielding material has a different color and comprises a light emitting part at a lower part of each of the light emitting part such that light is emitted from a part of the plurality of light emitting areas according to an operating state of the air conditioner.

8. The air conditioner of claim 1, wherein the light is emitted from a preset number of light emitting parts, and the preset number is preset according to an operating state of the air conditioner.

9. The air conditioner of claim 1, wherein the at least one displaying member displays one of a power supplying operation, a purifying operation, and a reserving operation.

10. The air conditioner of claim 1, wherein the at least one displaying member selectively displays at least one of three operating states such as an oxygen-supplying operation, a moisturizing operation and a reserving operation.

11. The air conditioner of claim 1, wherein the displaying board comprises at least one through hole to discharge at least one of oxygen, humid air and outside air.

12. The air conditioner of claim 1, further comprising a front panel provided in front of the inlet, wherein the inlet is selectively opened or closed by the front panel.

13. The air conditioner of claim 1, wherein an auxiliary inlet is formed on an upper surface of the case, and a suction grill is detachably provided at the auxiliary inlet.

14. The air conditioner of claim 13, wherein a filter unit is detachably provided at the suction grill.

* * * * *